US011885600B2

(12) United States Patent
Kiara et al.

(10) Patent No.: US 11,885,600 B2
(45) Date of Patent: Jan. 30, 2024

(54) PASSIVE CAVITY DEFLATION FOR IMPACTING BODIES AFTER WATER ENTRY

(71) Applicant: Utah State University, Logan, UT (US)

(72) Inventors: Areti Kiara, Logan, UT (US); Tadd T. Truscott, Logan, UT (US); Nathan Speirs, Logan, UT (US); Rafsan Rabbi, Logan, UT (US); Emma Fraley, Logan, UT (US); Kelli Hendrickson, Logan, UT (US)

(73) Assignee: Utah State University, Logan, UT (US)

( * ) Notice: Subject to any disclaimer, the term of this patent is extended or adjusted under 35 U.S.C. 154(b) by 0 days.

(21) Appl. No.: 17/947,030

(22) Filed: Sep. 16, 2022

(65) Prior Publication Data

US 2023/0417522 A1 Dec. 28, 2023

Related U.S. Application Data

(63) Continuation of application No. 17/391,974, filed on Aug. 2, 2021, now abandoned.

(60) Provisional application No. 63/059,353, filed on Jul. 31, 2020.

(51) Int. Cl.

| | |
|---|---|
| ***F42B 19/28*** | (2006.01) |
| ***F42B 10/46*** | (2006.01) |
| ***F42B 19/12*** | (2006.01) |
| ***F42B 99/00*** | (2006.01) |

(52) U.S. Cl.
CPC ..... *F42B 10/46* (2013.01); *F42B 19/125* (2013.01); *F42B 19/28* (2013.01); *F42B 99/00* (2013.01)

(58) Field of Classification Search
CPC ..... F42B 10/10; F42B 19/00; F42B 19/125; F42B 19/28; F42B 99/00
See application file for complete search history.

(56) References Cited

U.S. PATENT DOCUMENTS 6,684,801 B1 * 2/2004 Kuklinski ..... F42B 19/125 114/67 A
8,006,619 B1 * 8/2011 Kuklinski ..... F42B 19/00 102/399

(Continued)

*Primary Examiner* — J. Woodrow Eldred
(74) *Attorney, Agent, or Firm* — Thorpe North & Western, LLP.; Erik S. Ericksen

(57) ABSTRACT

A device is disclosed for deflating a gas cavity about a projectile formed upon entry of the projectile into a liquid. The device can include a wall coupleable with a body operable as a projectile and defining an exterior and an interior space. The wall can be oriented toward a trailing end relative to a leading end defined by the body. The device can also include at least one inlet to facilitate gas flow from the exterior to the interior space. An outlet can facilitate gas flow from the interior space to the exterior and can be oriented toward the trailing end relative to the at least one inlet. Upon entry of the body and the wall into a liquid and formation of a gas cavity about a portion of the body and the wall, the at least one inlet can be located within the gas cavity and the outlet can be located outside the gas cavity, such that gas flows from the exterior through the at least one inlet to the interior space, and from the interior space through the outlet to the exterior to deflate the gas cavity.

23 Claims, 8 Drawing Sheets

(56) References Cited

U.S. PATENT DOCUMENTS

2011/0297032 A1* 12/2011 Fu ..... F42B 19/125
102/399
2013/0298819 A1* 11/2013 Jung ..... B63B 1/36
114/312

* cited by examiner (c)

$t = 0\ ms$ 25 50 75 89 103 117

$t = 0\ ms$ 24 48 71 86 103 117

$t = 0\ ms$ 23 46 70 85 100 117

$t = 0\ ms$ 23 46 70 85 100 116

PASSIVE CAVITY DEFLATION FOR IMPACTING BODIES AFTER WATER ENTRY

CROSS REFERENCE

This application claims the benefit of U.S. Provisional Application No. 63/059,353, which was filed on Jul. 31, 2020, the entire contents of which are incorporated herein by reference.

BACKGROUND

Under specific impact conditions, objects form subsurface air cavities when they enter a quiescent water surface, which cavities persist for an extended time. More specifically, as illustrated in FIG. 1, when a sphere 105 impacts a water surface 110, the sphere 105 displaces the water 110 and a thin, upward-moving film 115 forms around the sphere 105, known as a splash crown 115 (FIG. 1(*a*)). As the sphere 105 descends below the free surface 110, air 120 from above is entrained behind the sphere 105, forming a cavity 120 (FIG. 1(*b*)). As the sphere 105 continues to descend, hydrostatic pressure causes the cavity walls to collapse inward until the walls touch one another at a single point 125, an event known as pinch-off, (FIG. 1(*c*)) and the cavity splits into an upper cavity 130 and a lower cavity 135. At the pinch-off point 125, two jets are formed due to the high pressure. One jet moves upwards through the upper cavity 130 to the atmosphere 140 and the other jet moves downward through the lower cavity 135 until it impacts the sphere 105 (FIG. 1(*d*)).

It is generally known that air cavities may form where impact velocity exceeds a threshold, depending on the contact angle. It has also been learned that that cavity formation may depend, among other things, on the formation and behavior of the splash crown, and that cavity shape depends on the contact angle.

In addition, acoustic signatures of water entry have been studied for different projectiles and cavity types to understand how objects can be identified underwater. It has also been predicted that projectiles type can potentially be identified, based on among other things, by detecting a dominate frequency of the projectile.

SUMMARY

Despite the above understanding, dissipation of cavities by cavity deflation remains a largely unexplored phenomenon. A device is disclosed for deflating a gas cavity about a projectile formed upon entry of the projectile into a liquid. The device may include an enclosure wall configured to couple with a body operable as a projectile. The wall can define an exterior and an interior space and can extend generally along a travel axis of the body. The wall may be oriented toward a trailing end relative to a leading end defined by the body. The device may also include at least one inlet to facilitate gas flow from the exterior to the interior space, where the inlet is oriented adjacent a leading end of the enclosure wall. In addition, the device may include an outlet to facilitate gas flow from the interior space to the exterior. The outlet may be oriented toward the trailing end relative to the at least one inlet. Upon entry of the body and the wall into a liquid and formation of a gas cavity about a portion of the body and the wall, the at least one inlet may be located within the gas cavity and the outlet may be located outside the gas cavity, such that gas flows from the exterior through the at least one inlet to the interior space, and from the interior space through the outlet to the exterior to deflate the gas cavity.

A system for deflating a gas cavity about a projectile formed upon entry of the projectile into a liquid is also disclosed. The system may include a body operable as a projectile. The body can have a leading portion defining a leading end. The system can also include a wall associated with the body. The wall can define an exterior and an interior space. The wall can be oriented toward a trailing end relative to the leading end. The system can further comprise at least one inlet to facilitate gas flow from the exterior to the interior space. Additionally, the system can comprise an outlet to facilitate gas flow from the interior space to the exterior. The outlet can be oriented toward the trailing end relative to the at least one inlet. The wall can be either attached to an exterior of the body or integrated into the body with inlet and outlet being oriented at a surface of the body. Upon entry of the body and the wall into a liquid and formation of a gas cavity about a portion of the body and the wall, the at least one inlet can be located within the gas cavity and the outlet can be located outside the gas cavity, such that gas flows from the exterior through the at least one inlet to the interior space, and from the interior space through the outlet to the exterior to deflate the gas cavity.

The foregoing outlines, rather broadly, some features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

Figure 1:
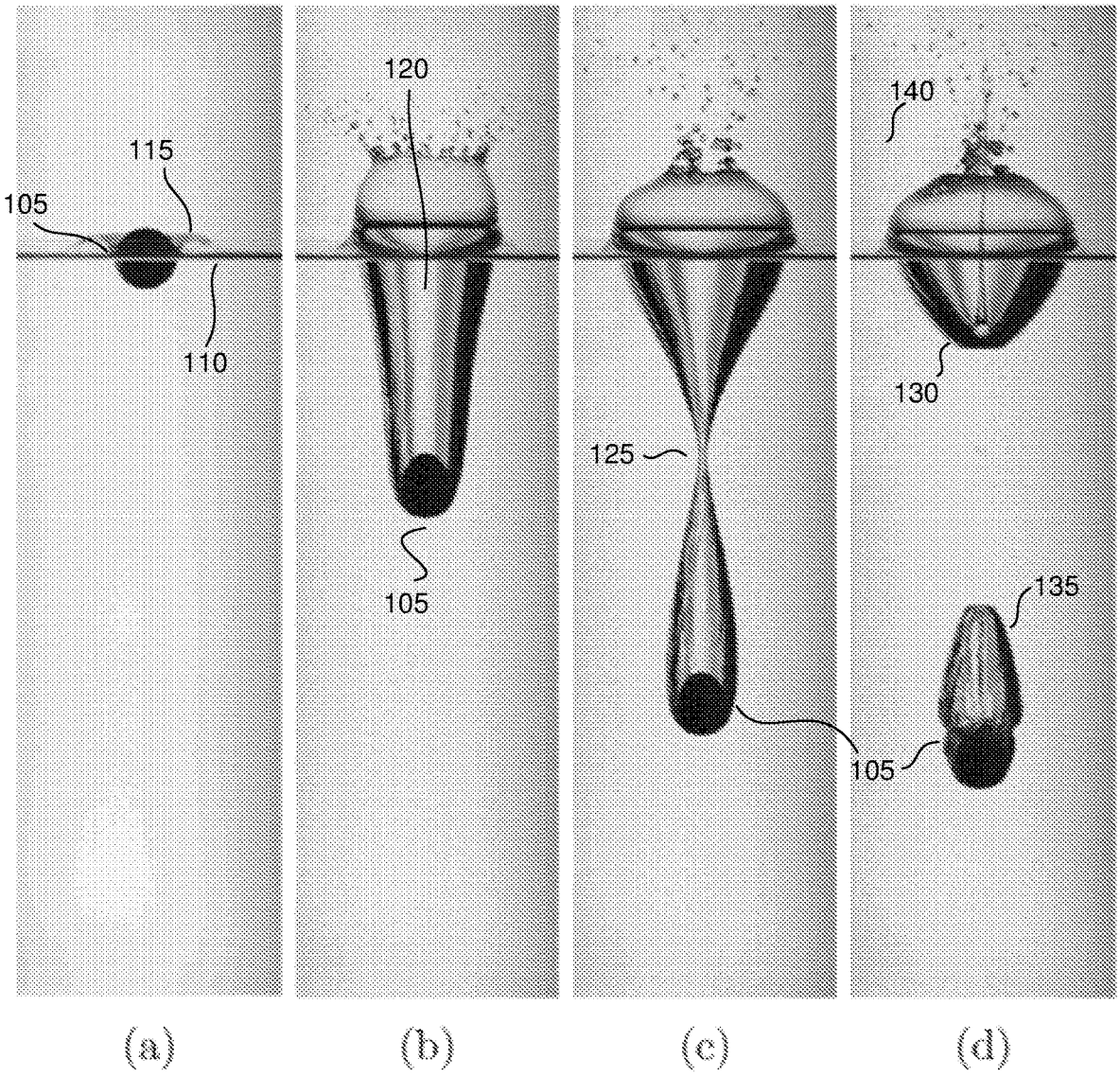
FIG. 1 PRIOR ART
FIG. 1 shows entry of a spherical object into a body of water, in accordance with the prior art.

These drawings are provided to illustrate various aspects of the invention and are not intended to be limiting of the scope in terms of dimensions, materials, configurations, arrangements or proportions unless otherwise limited by the claims.

DETAILED DESCRIPTION

While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

Definitions

In describing and claiming the present invention, the following terminology will be used.

The singular forms "a," "an," and "the" include plural referents unless the context clearly dictates otherwise. Thus, for example, reference to "a hole" includes reference to one or more of such features, and reference to "impacting" refers to one or more such steps.

As used herein, the term "about" is used to provide flexibility and imprecision associated with a given term, metric or value. The degree of flexibility for a particular variable can be readily determined by one skilled in the art. However, unless otherwise enunciated, the term "about" generally connotes flexibility of less than 2%, and most often less than 1%, and in some cases less than 0.01%.

As used herein with respect to an identified property or circumstance, "substantially" refers to a degree of deviation that is sufficiently small so as to not measurably detract from the identified property or circumstance. The exact degree of deviation allowable may in some cases depend on the specific context.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

As used herein, the term "at least one of" is intended to be synonymous with "one or more of." For example, "at least one of A, B and C" explicitly includes only A, only B, only C, and combinations of each.

Numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of about 1 to about 4.5 should be interpreted to include not only the explicitly recited limits of 1 to about 4.5, but also to include individual numerals such as 2, 3, 4, and sub-ranges such as 1 to 3, 2 to 4, etc. The same principle applies to ranges reciting only one numerical value, such as "less than about 4.5," which should be interpreted to include all of the above-recited values and ranges. Further, such an interpretation should apply regardless of the breadth of the range or the characteristic being described.

Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

Cavity Deflation Systems

As mentioned above, when an object enters water, a crater, or air cavity, can form around the object and remain attached as the object travels underwater. Although cavities decrease drag for energy saving applications, it may sometimes be beneficial to remove the cavities. Even where cavities may eventually collapse naturally, it may be desirable in some instances to dissipate cavities before that occurs.

This may be the case, for example, in some applications involving launching an autonomous underwater vehicle (AUV) into a body of water. For instance, launching an AUV into water via aircraft may reduce launch preparation time, and expand the monitoring range and exploration depth, but may entail certain drawbacks. Specifically, when a AUV enters the water in this manner, the water may usually separate from the device, forming a crown splash that closes in a dome above the free surface line. This then creates and seals an air cavity that trails the descending/sinking projectile.

This sealing of a cavity usually occurs several diameters under the surface and can leave a portion of the cavity attached to the object. For naval applications, air cavities often seal in two ways (although other ways and cavity types exist). First, air cavities may seal near the surface of the body of water (known as surface seal), which usually occurs with higher projectile entry speeds. Second, air cavities may seal approximately halfway between the projectile or object's position and the surface of the water (known as deep seal), which usually occurs at more moderate entry speeds.

Although these events occur within a few milliseconds, the cavities can persist for 1-100 seconds depending on the depth and speed of the object/projectile. As the projectile descends into the water, the ambient external water pressure increases. To balance the external increase in pressure, the trailing compressible air cavity reduces in size. When the ambient water pressure exceeds a certain value, the cavity eventually collapses. This collapse generates significant, audible pressure disturbance. In addition, cavity pinch-off and subsequent cavity ripples may produce noise.

These resulting sounds can be undesirable, especially for projectiles that need to be launched into the water discreetly to avoid detection, such as torpedoes used in military operations.

In addition, for commercial as well as naval applications, the presence of, and/or the time required to deflate, cavities can have a substantial impact on efficiency and on operations generally. For instance, persistent cavities in the wake of boats can cause the propellers to function improperly. Even a stationary object such as an oil platform can be affected by cavities that form in the wake of slamming waves. Similarly, if collapse occurs close to a torpedo propeller, it can cause material damage. Additionally, some projectiles that enter from a free surface may need to be wetted to operate. Relatedly, a torpedo may need fluid to flood compartments in order for chemical engines to ignite (and air cavities may inhibit such flooding).

Described herein are devices, systems, and/or methods for dissipating cavities by means of deflation. Relatedly, some technologies described herein can be used to modify water-borne projectiles to reduce turbulence and noise associated with the collapse of air cavities that form around the projectile upon surface entry. In some respects, such technologies may provide an attachment to a projectile for eliminating disturbance associated with the projectile entering the water. In some examples, the attachment may involve modifying the physical structure of the projectile, causing the water to separate from the projectile at a lower point on the projectile.

Figure 2A:
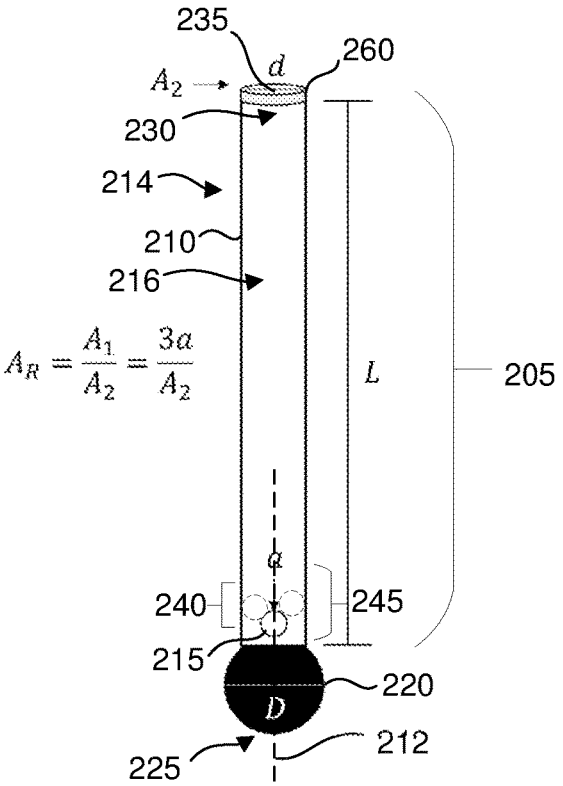
FIG. 2A is a schematic of a spherical projectile including a cavity deflation attachment in accordance with one example of the present disclosure.

As an illustrative example, FIG. 2A shows a passive cavity deflation mechanism 205 to a tail end of a projectile 220. For example, the passive cavity deflation mechanism can be attached at the end of an AUV or another object. It is understood that a tail end includes any trailing surface of an object, e.g., a trailing edge of a propeller blade, etc. In one aspect, such a device or mechanism may include a rigid, hollow tube 210 attached to an impacting body (e.g., sphere) designed to expedite the deflation and collapse of the air cavity. In this case, the tube can extend generally along a travel axis 212 of the projectile 220. As an exterior attachment, the tube can generally be oriented parallel to and along the travel axis 212. However, in some cases deviation of the tube from the travel axis can be used depending on the projectile. For example, generally the tube can be within about 10° of parallel with the travel axis.

To facilitate cavity deflation after water entry, the tube 210 may be perforated with radial vent holes 215 as deflation inlets. The radial vent holes 215 may be located near the base of the tube—for instance, near to or where the tube 210 may attach to the sphere 220 or projectile, which may often be where or near to where the cavity forms. This may provide the air in the cavity a means to escape after sealing, by allowing the air to move from the cavity out through the tube 210. In terms of location along the tube, the deflation inlets can generally be as close as possible to the projectile as manufacturing will allow, depending on the material of the device. Once the cavity reaches the deflation inlets, water starts to enter the tube and no more deflation occurs. Thus, the lower the deflation inlets are (i.e. further forward along the direction of projectile travel) the more volume of cavity can be removed. Notably, the pressure on the air bubble is theoretically highest at the equator (or where the tube is connected to the sphere geometry in the spherical projectile example), which should facilitate the rate of bubble deflation. Thus, orienting the vent holes as close as possible to the projectile can also improve rate of deflation.

As a general guideline, the deflation inlets can be oriented and evenly spaced around a radius of the projectile. The deflation inlet can include a plurality of inlets which are distributed about a perimeter of the tube. Similarly, the shape of the inlets can vary considerably, e.g., circular, elliptical, square, rectangular, slits, mesh, etc. The number and shape of inlets can vary, although a total inlet area is one significant factor. As a general guideline, the total inlet area can be 0.1 times the outlet area or larger.

The tube 205 may form part of a corresponding system for deflating a gas cavity about a projectile (e.g., a sphere) 220, which cavity may be formed upon entry of the projectile into a liquid. The projectile 220 may include a body having a leading portion defining a leading end 225. The tube 210 can be defined as a wall which is associated with the body, defining an exterior space 214 and an interior space 216. The wall can also include a trailing end 230 opposite to and remote from the leading end 225. In addition, at least one inlet 215 in the wall can facilitate gas flow from the exterior to the interior space. This inlet provides a fluid pathway for air within a cavity to access the interior space 216. Also, an outlet 235 in the wall may facilitate gas flow from the interior space to the exterior. In some examples, the outlet 235 can be oriented toward the trailing end 230 relative to the at least one inlet 215. The wall can be rigid, and in some cases may be flexible. The wall can be rigid or flexible, depending on the application and associated projectile.

Upon entry of the body and the wall into a liquid and formation of a gas cavity about a portion of the body and the wall, the at least one inlet 215 may be located within the gas cavity and the outlet 235 may be located outside the gas cavity, such that gas may flow from the exterior through the at least one inlet 215 to the interior space, and from the interior space through the outlet 235 to the exterior to deflate the gas cavity. In some cases, both the at least one inlet 215 and the outlet 235 can be located within the gas cavity, although such configuration can be less effective than orienting the outlet outside the gas cavity. In such cases, the at least one inlet 215 acts to allow gas/air to be transferred away from the trailing end of the projectile 220.

As a general observation, air in the cavity above the inlets moves through the inlets. As the air from above moves through the inlets the cavity length shrinks until it reaches the deflation inlets. Once the cavity reaches the deflation inlets, water enters the tube preventing any further deflation via the deflation mechanism. For this reason the deflation inlets can be oriented as close to the projectile as possible, so that as much of the cavity as possible can be deflated and removed before water starts to enter the tube, preventing further air from leaving the cavity. In other words, a strong pressure differential across the inlet and outlet can be maintained such that the inlet has access to the volume of the cavity that needs deflation. The inlets can be placed with access to the desired region where the cavity needs to be deflated and the outlet(s) can be placed to maximize a pressure differential across the tube.

Notably, the cavity deflation time to reach less than 10% of an initial cavity volume can be less than about 30 ms, from deep seal. However, this is dependent on placement of the inlets since inlets closer to the projectile body will enable higher deflation volumes at faster rates. In some cases, these cavity deflation times can achieve a cavity volume of substantially 0% of the initial cavity volume. Factors that affect the rate of cavity deflation include the cavity diameter and inlet area (determined by area ratio) which impacts the amount of air that is able to enter the tube at given time. The larger the diameter and the larger the inlet area the more air is able to enter the tube at a given time. The length of the tube impacts how long the outlet is above the free surface and the longer the outlet is above the free surface, the more air can exit the straw during entry of the projectile and trailing tube. Regardless, the passive cavity deflation mechanisms can include no moving parts.

The enclosure wall can be formed in any suitable configuration. As non-limiting examples, the wall can be a hollow tube 210. In some cases, the wall may be a separate and distinct structure from the body, which can be manufactured and installed separately. In these cases, the attachment can be an after-market device which is secured to an existing projectile. Securing can be achieved through any suitable mechanism such as, but not limited to, brazing, welding, bolts, pins, adhesive, screws, rivets, and the like. Alternatively, the wall may be integrated into the body structure. For example, an enclosure wall can be formed directly within a portion of a torpedo, boat hull body, or surfboard fin where inlet(s) are oriented forward of corresponding outlets.

The hollow tube 210 may have cross-sectional shapes such as circular, elliptical, complex curved, squared, polygonal, conical (e.g., with a taper toward the trailing end 230) or the like. The diameters or the openings at the leading end 225 and trailing end 230 of the hollow tube 210 can be carefully determined, especially the trailing end opening 235, which can be consistent with the gas cavity diameter d. The diameter ratio of the trailing end 230 and the leading end 225 of the tube 210 can control the cross-sectional shape around the vertical axis of the tube 210. The at least one inlet 215 may include at least one opening 215 through the wall and may be generally located toward a leading end 225 of the enclosure wall.

The total area of the inlet vent holes impacts how much air can enter the vented tube within a given time. A corresponding total area of the outlet (or plurality of outlets) can determine exit volumes for captured air within the tube. A ratio of the total inlet area to the total outlet area can affect the volumetric flow rate of air through the tube and thus the deflation rate of the cavity. As the area ratio increases, the vent hole area increases, which allows more air to enter the vented tube while air can escape to the free surface compared to smaller area ratios. Thus, the amount of deflation generally may increase as the area ratio increases. As a general guideline, the area ratio can range from about 0.1 to 2 or more, and most often 0.5 to 1 (inlet area/outlet area).

Although the number of openings can vary, in one example, the at least one inlet 215 includes at least three openings 245 in the wall evenly spaced around a circumference of the wall. In another example, the at least one inlet 215 comprises a plurality of inlets all located at a same longitudinal position 240 on a longitudinal axis 240 extending between the leading and trailing ends 225, 230. In some cases, openings can be spaced longitudinally. However, in some examples, such opening locations can be limited to within about 2 wall diameters of the leading end 225. In some cases, longitudinally spaced openings can also be radially offset from openings further forward. In one example, an axis of the at least one inlet 215 is oriented perpendicular relative to a longitudinal axis extending between the leading and trailing ends 225, 230. In another example, an axis of the outlet 235 is parallel to a longitudinal axis 212 extending between the leading and trailing ends 225, 230.

Although dimensions may vary depending on a particular application, as an example, a ratio of inlet area a to outlet area $A_2$ is from about 0.1 to about 2. Similarly, a diameter of the wall can be greater than or equal to 0.5 times a diameter of the body. Notably, the diameter of the tube can be less than or equal to the diameter of the body. The larger the tube diameter is, the more air it can hold, such that the amount of air exiting the cavity increases compared to a smaller diameter tube. In yet another example, the at least one inlets 215 are oriented from the leading end of the enclosure wall within 2 times a diameter of the wall. The cross-sectional shape of the tube around the vertical axis depends on the diameter d or opening area ratio of the leading end 225 and trailing end 230 of the tube 210.

In one example, if the opening diameters of a circular cross-section tube (about the longitudinal axis 212) are d1 and d2 respectively for the leading and trailing ends of the tube, the value d2/d1=1 indicates to a rectangular cross-sectional (about the vertical axis) tube. In yet another example, d2/d1>1 would indicate a conical funnel tube, whereas d2/d1<1 indicates a reverse conical funnel. The reverse conical funnel has the shape of converging nozzle, which can contribute to increasing the downwards moving velocity of the projectile by speeding up the shedding of air bubbles through the trailing end of the tube (i.e. a result of the venturi effect due to pressure differentials resulting from changing cross-section areas).

As another option, a second wall can be configured to couple with the body, the second wall defining a second interior space separated from the exterior, and the second wall being oriented toward the trailing end relative to the leading end. At least one second inlet can facilitate gas flow from the exterior to the second interior space, while a second outlet can facilitate gas flow from the second interior space to the exterior, the second outlet being oriented toward the trailing end relative to the at least one second inlet. In this case, upon entry of the body and the second wall into the liquid and formation of the gas cavity, the at least one second inlet is located within the gas cavity and the second outlet is located outside the gas cavity, such that gas flows from the exterior through the at least one second inlet to the second interior space, and from the second interior space through the second outlet to the exterior to deflate the gas cavity.

In another option, the device can further comprise a hydrophobic coating on at least a portion of the body, the wall, or both. Further, a hydrophobic coating can be deposited on one or both of interior and exterior surfaces of the wall. Hydrophobic coatings can be formed using any suitable technique such as, but not limited to, chemical deposition, physical vapor deposition, atom layer deposition, sputtering, lacquering, etc. Non-limiting examples of suitable coatings can include silica, fluorinated hydrocarbons, superhydrophobic materials, and the like.

Example

A series of experiments were performed using varying tube lengths, radial hole areas, drop heights, surface coatings, etc., to assess what factors influence cavity deflation. Such experiments include comparing spherical projectiles with and without a vented tube, different vented tube lengths, vented tube diameters, vent hole areas (and area ratios), and impact velocities. The experiments were performed utilizing high-speed cameras 275 (as shown in FIG. 2B) and image processing to quantify and compare the cavity sizes and deflation, the summaries of which follow.

Figure 2B:
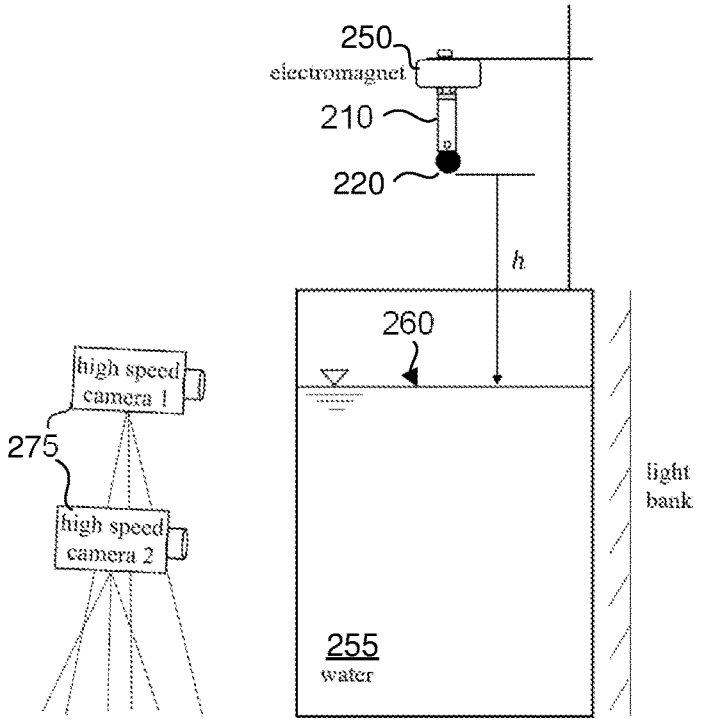
FIG. 2B is a schematic illustration of an experimental setup in accordance with an example of the present disclosure.

FIG. 2B is an experimental setup schematic shows the sphere 220 and tube 210 that were dropped into a tank of water 255 from drop height h by an electromagnet 250. The drop height h determines the speed at which the sphere 220 and tube 210 impact the water 255 and are measured from the free surface 260 to the bottom of the sphere 220. The electromagnet 250 was on a track that allowed its height to be adjusted to account for different drop heights and tube lengths. In such experiments, the tank 255 was 457 mm×457 mm×1168 mm with a water height of 863 mm.

FIG. 2A shows a schematic of the sphere 220 and tube 210 schematic labeled with important variables: tube length, L; tube diameter, d; sphere diameter, D; area of one vent hole, a; vent hole area, $A_1$=3a; tube opening area, $A_2$. In these examples, the tube 210 was a polycarbonate tube with an inner diameter of 12.7 mm and a wall thickness of 1.5875 mm. The tube 210 was also attached to a 25.4 mm stainless-steel sphere with E6000 adhesive. Three vent holes 215, 245 were evenly spaced around the circumference of the tube 210, 120° apart and 12.7 mm from the bottom of the tube 210. A stainless-steel ring 260 with an inner diameter of 12.7 mm, wall thickness of 1.59 mm, and height of 1.59 mm was attached to the top of the tube 210 with E6000 adhesive so that the top of the tube 210 was magnetic. The sphere 220 was coated in Cytonix WX2100 hydrophobic spray which has a contact angle of 117°.

Figure 3A:
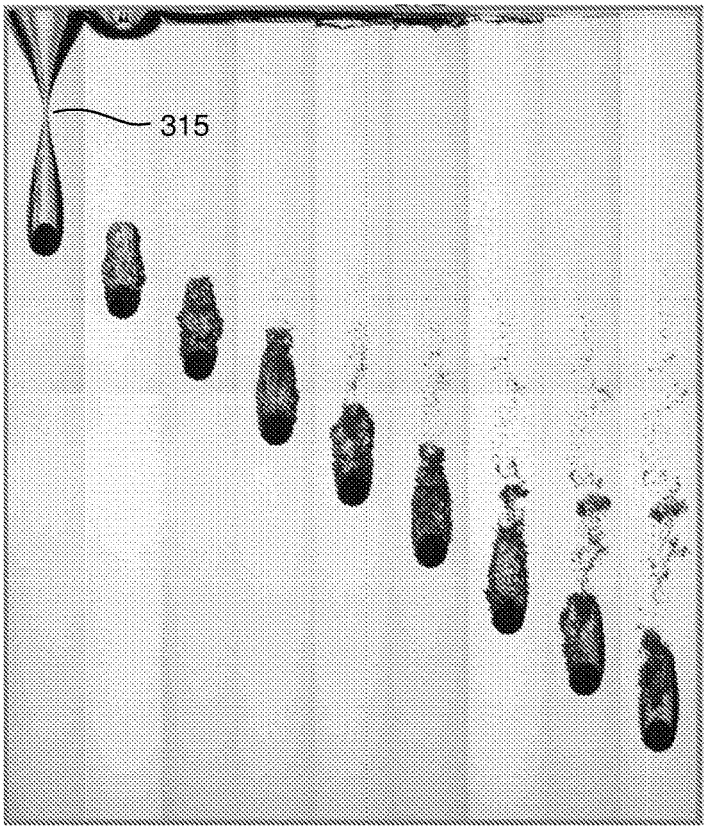
FIGS. 3A-B is a collection of images of the experiment showing cavity formation and deflation for sphere only and vented tube cases.
Figure 3B:
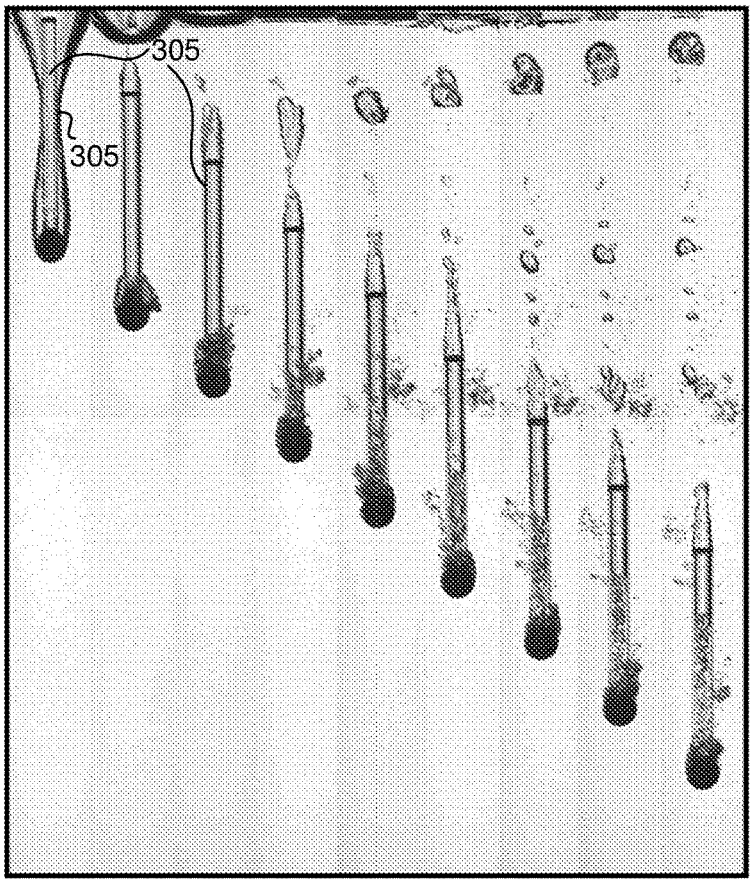
Figure 3C:
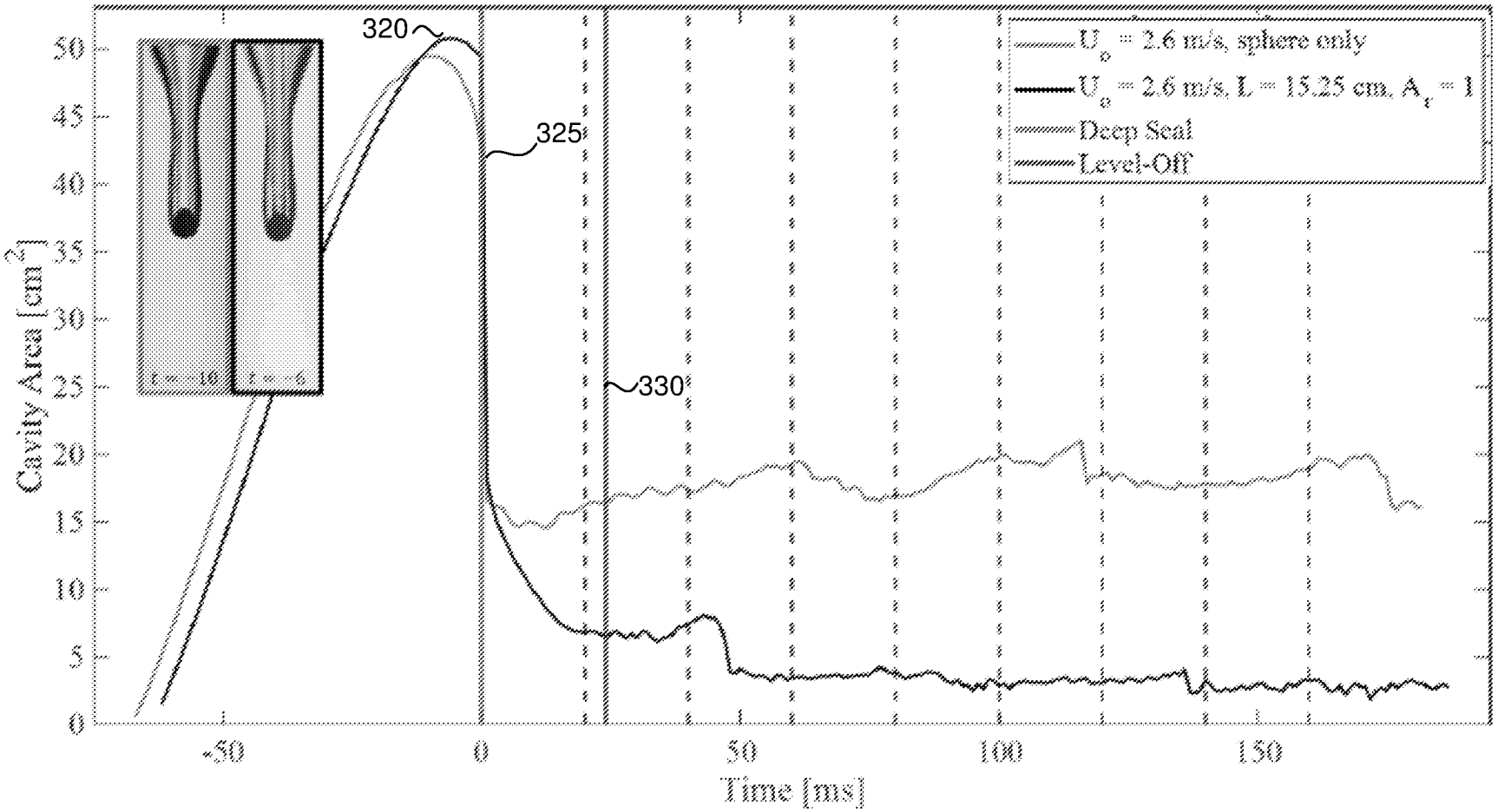
FIG. 3C is a graph of cavity area over time for a sphere only and a sphere including a projectile cavity deflation attachment, in accordance with aspects of the present disclosure.

One set of experiments compared a sphere only case and a vented tube case, as shown in FIGS. 3A-C. For both cases the impact velocity was $U_o$=2.6 m/s, the sphere diameter was D=2:54 cm, and the contact angle was θ=117 degrees. For the vented tube case, the vented tube diameter was d=1:27 cm, the vented tube length was L=15:24 cm, and the area ratio was $A_r$=1. For both image sequences the time started at deep seal and the time between frames was Δt=20 ms.

For the sphere only case, deep seal occurred when the walls of the cavity touch at one point. For the vented tube case, the walls of the cavity 305 touched the vented tube 310 before they could touch at one point, which caused an early deep seal pinch-off. Deep seal for the vented tube case was more abrupt than for the sphere only case as there was only a slight decrease in cavity area before the cavity walls touched the vented tube compared to the greater decrease in cavity area before the walls of the cavity 315 touched naturally. The slight difference in deep seal between the sphere only and vented tube cases did not impact aligning the two cases at deep seal.

As shown in FIG. 3C, the two lines in the cavity area plot represent time of deep seal and time of deflation level-off, respectively. For the cavity area study, deep seal is at t=0 so that deflation is easily compared. The vertical dashed lines correspond with frames 2-9 of the image sequences in (a) and (b).

FIG. 3C shows that before deep seal, the maximum cavity area for the vented tube case was slightly larger 320 than the cavity area for the sphere only case. The images of both cavities when they are at their maximum cavity area, 117 ms after impact for both cases, were inset in FIG. 3C. The inset images show that the cavity depth (measured from the free surface to the center of the sphere) at the time of maximum cavity area was slightly greater for the vented tube case and therefore, the vented tube case cavity had entrained more air than the sphere only case cavity. The cavity area for the vented tube case at deep seal was about 7 $cm^2$ larger than the cavity area of the sphere only case at deep seal.

Immediately after deep seal the cavity area dropped dramatically 325, which was due to what area was tracked. Specifically, for deep seal and the frames before deep seal the entire cavity was tracked; while after deep seal only the lower cavity was being tracked.

In the second frame of the image sequences (FIGS. 3A-B), at 20 ms after deep seal, the cavity for the vented tube case was already substantially smaller than the traditional cavity in the sphere only case. The change in cavity area after deep seal for the vented tube case was due to cavity deflation facilitated by the vent holes in the vented tube and is further seen in FIG. 3C. Between deep seal and 20 ms the cavity for the vented tube case decreased by almost two-thirds while the cavity for the sphere only case remained relatively constant. At 20 ms the vented tube case cavity area was 40% of the sphere only case cavity area. Cavity deflation occurs between deep seal and the level-off point which was marked by the vertical line 330 in FIG. 3(*c*). Level-off occurs when the distance between the top of the cavity and the top of the vent holes stops decreasing and the deflation levels-off. For this vented tube case, deflation level-off 330 occurred at 24 ms, when the cavity reached the vent holes, at which point deflation was no longer possible as water began to fill the vented tube, trapping any remaining air.

Despite the fluctuations due to cavity shedding, FIG. 3C and FIG. 3A show that as the sphere only case continued to descend, the cavity size remains relatively constant. In contrast, as the vented tube case continued to descend after level-off 330, the cavity area remained relatively constant for the next 10 ms but it began to increase slightly (as shown in FIG. 3C). As with the sphere only case, the increase in cavity area for the vented tube case was due to cavity shedding. Then, as the cavity area prepared to shed, the cavity area increased slightly due to the change in cavity shape and as seen in frame 3 of FIG. 3B. The vented tube case image sequence (FIG. 3B) and cavity area profile (FIG. 3C) both show that between 30 and 40 ms a significant portion (40%) of the remaining cavity was shed. For the remaining time the cavity dissipated slowly by shedding small air bubbles. By the final frame of the image sequences (FIGS. 3A-B), the cavity for the vented tube case was substantially reduced compared to the sphere only case. More specifically, at the end of the time frame the cavity area for the sphere only case was virtually unchanged while the cavity area for the vented tube case was reduced to 15% of the original cavity volume.

Other sets of experiments with corresponding data were also performed. For example, one set involved four comparing tube lengths (L=38.1, 76.2, 114.3, and 152.4 mm), three drop heights (h=250, 350, and 450 mm), and five ratios of vent holes area ($A_1$=3a) to tube opening area ($A_1/A_2$=0.1, 0.2, 0.5, 1, and 2), for a total of 60 cases.

FIGS. 4A-D shows cavity formation and deflation for four of those cases, and highlights a comparison between the cases. The first frame is the impact frame, the fourth frame is where deep seal occurs, and the seventh frame is the last frame that the entire sphere and tube is in view. The time from impact (t=0 ms) are indicated in the images. For each case, the drop height was h=350 mm and the area ratio was $A_1/A_2$=1. The tube length was varied in each case: (a) L=38.1 mm, (b) L=76.2 mm, (c) L=114.3 mm, and (d) L=152.4 mm.

Figure 4A:
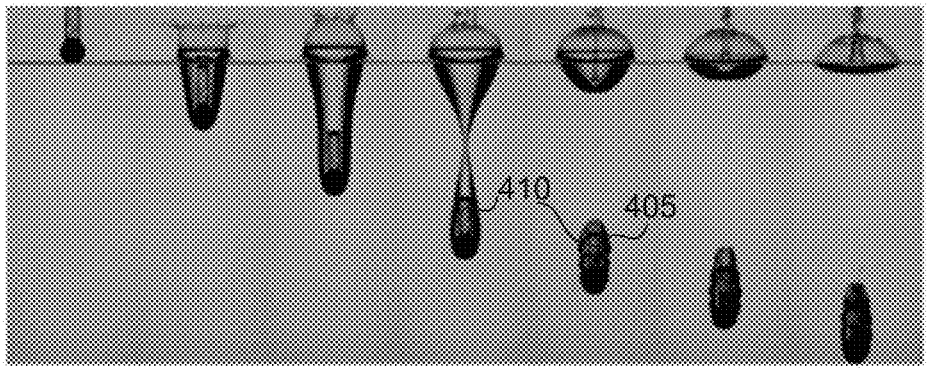
FIGS. 4A-D is a collection of images of the experiment showing cavity formation and deflation for four cases, in accordance with aspects of the present disclosure.
Figure 4B:
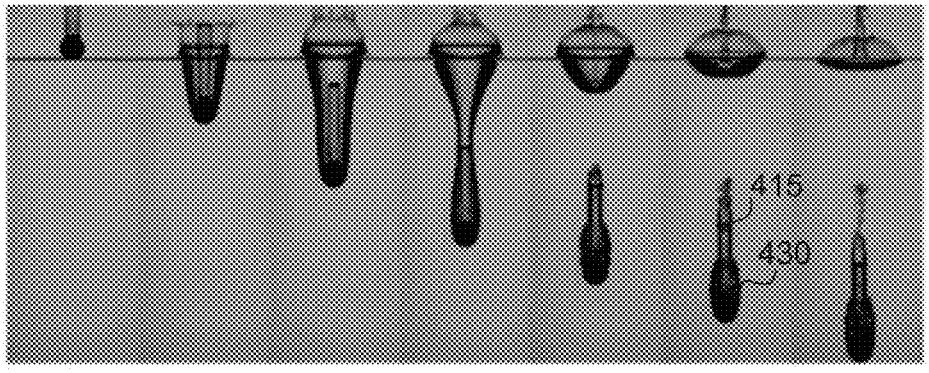
Figure 4C:
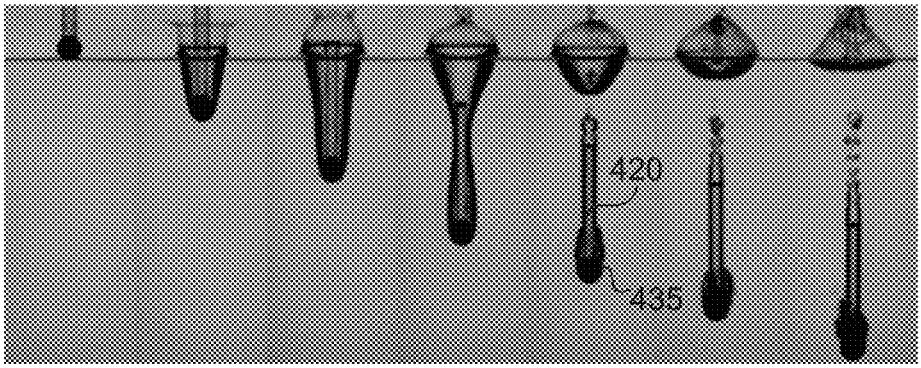
Figure 4D:
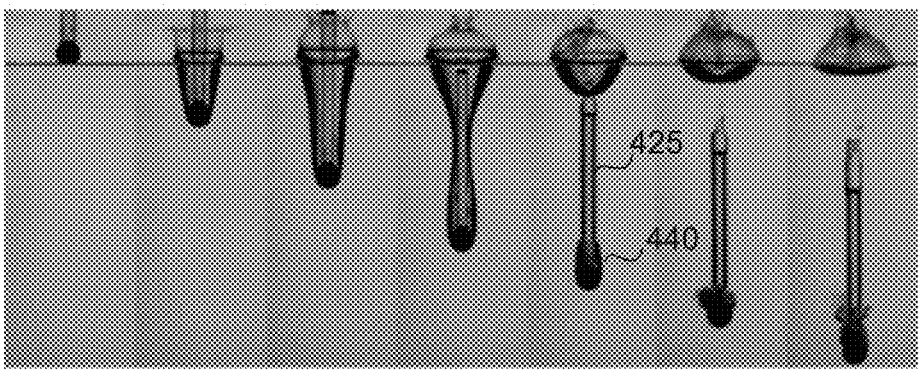

In FIG. 4A, deep seal occurred above the tube 410 and the Kiara Tube 410 was contained inside of the cavity 405. In FIGS. 4B, 4C, and 4D deep seals occurred on the tubes 415, 420, 425 and a portion of the tubes 415, 420, 425 were above the lower cavities 430, 435, 440 after deep seal. As also seen in the figures, noticeable cavity deflation occurred in FIGS. 4C and 4D. There was some cavity deflation in FIG. 4B but none in FIG. 4A. The cavity in FIG. 4D also appears to have deflated quicker than the cavity in FIG. 4D, revealing that tube length is proportional to deflation rate.

Figure 5:
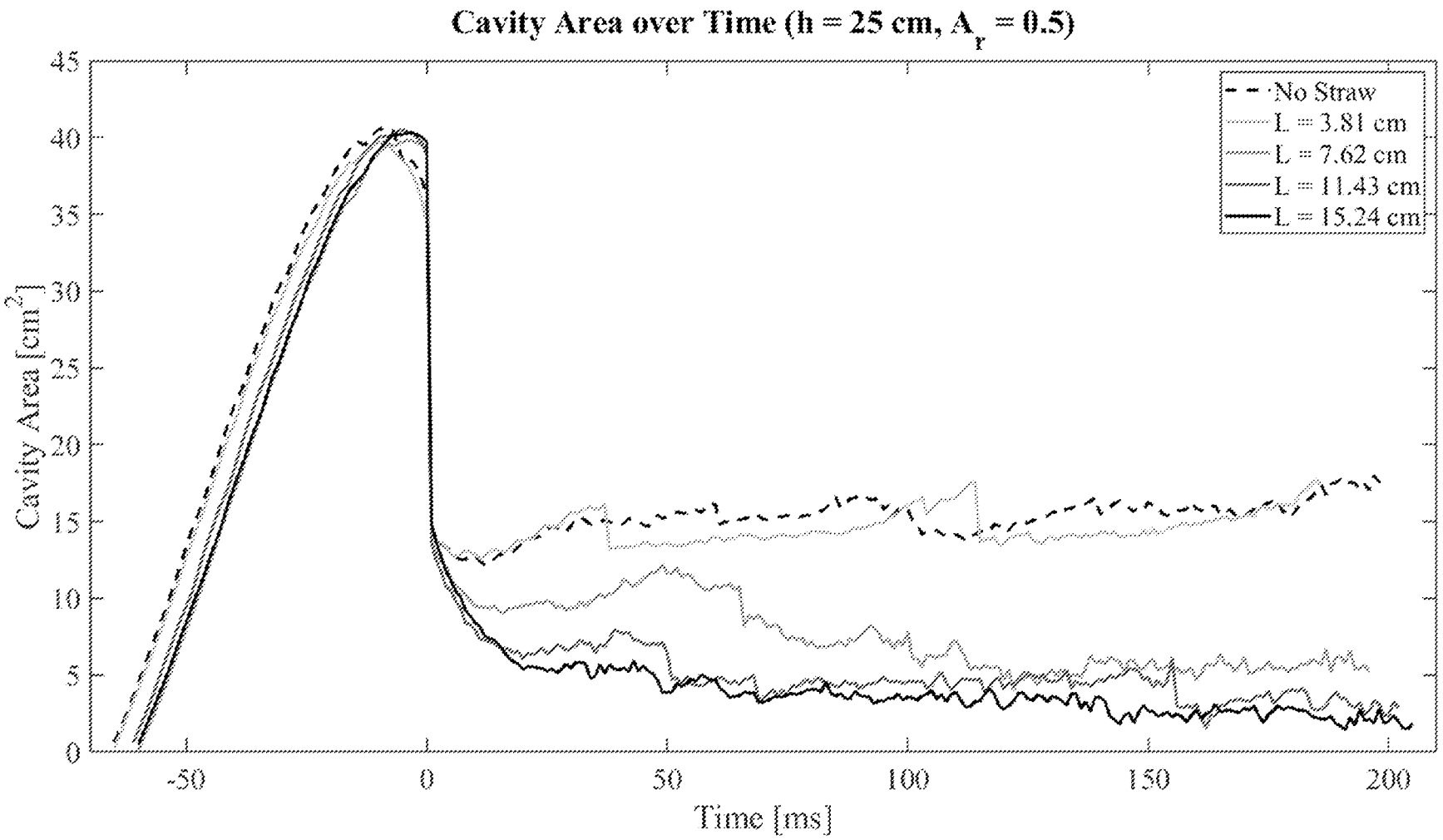
FIG. 5 is a graph of experimental results showing cavity volume as a function of time for four different projectile attachment lengths, in accordance with aspects of the present disclosure.

FIG. 5 shows the cavity volume as a function of time (starting at impact) for each of the four different tube lengths at the same drop height (h=350 mm) and same area ratio ($A_1/A_2$=1). Each millisecond is a different frame. The four cavities formed at a similar rate until near their maximum cavity volume values where they differed slightly. The cavities then began to shrink at a similar rate until deep seal occurred when the cavity volume decreased significantly (the vertical lines in the plot). After deep seal occurred the four cavity deflation rates differed. The cavity for the 38.1 mm tube did not deflate but the volume oscillated. The oscillations were likely due to pressure differences caused by the acoustic waves. The cavities for the 76.2 mm and 114.3 mm tubes deflated for a few milliseconds but then leveled out and the volume oscillated similar to the 38.1 mm tube cavity. The cavity for the 152.4 mm tube had the largest deflation volume and went out of frame before oscillations occurred or full deflation could be viewed (FIG. 3D). While the deflation time was different for the 76.2 mm, 114.3 mm, and 152.4 mm tube cavities, the rate of deflation was similar.

Figure 6:
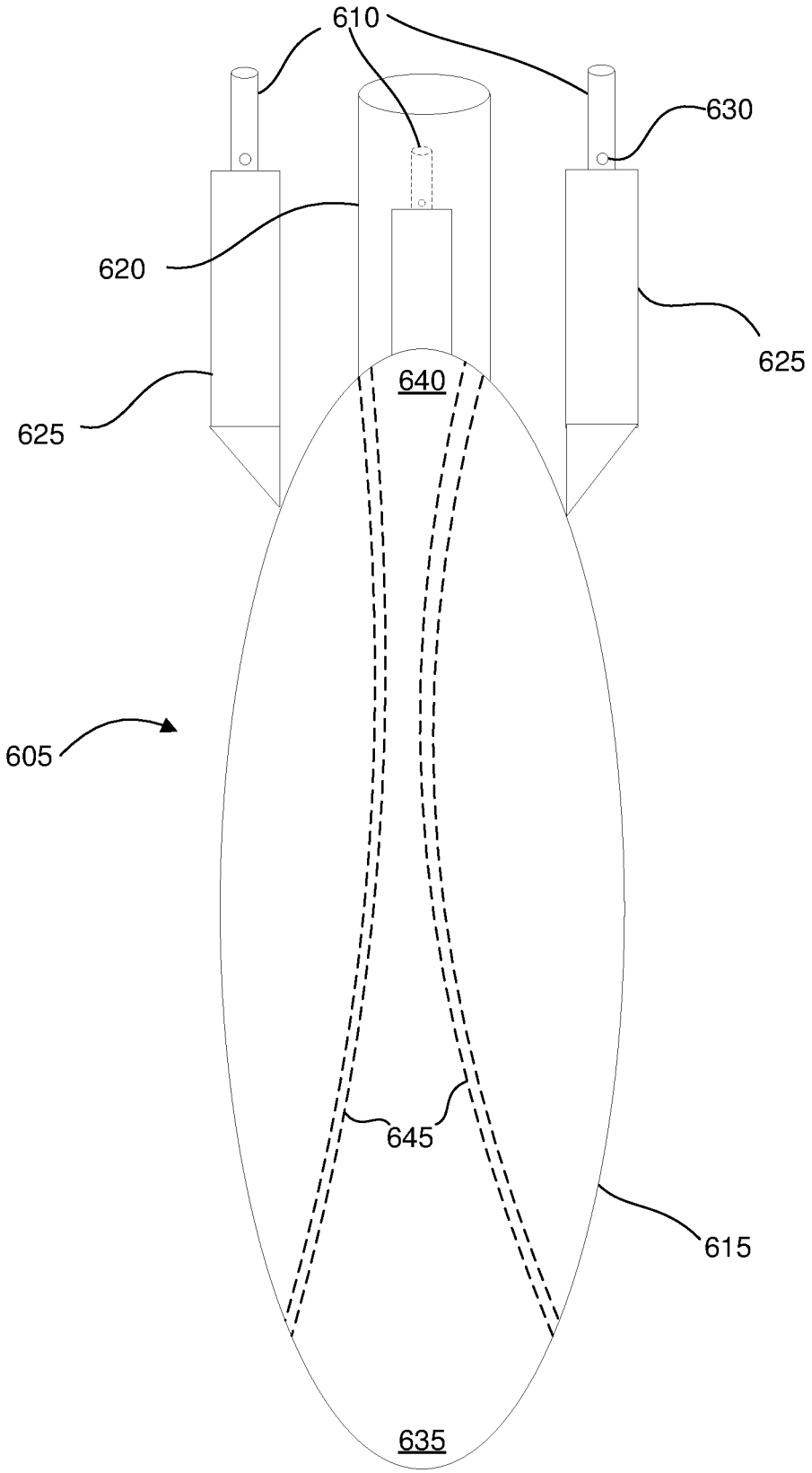
FIG. 6 is a schematic of a Kiara tube with a torpedo, in accordance with various aspects of this disclosure.

FIG. 6 shows an example of the deflation tube 610 used with a UAV 605, in accordance with various aspects of this disclosure. More specifically, FIG. 6 shows a torpedo 605 with several tubes 610 implemented thereon to decrease or remove air from air cavities. The torpedo 605 can have a main body 615 with a front end 635 and a back end 640 opposite the front end 635. The main body 615 can also have a plurality of tubular channels 645 passing through the main body 615 for channeling air, examples of which are shown. The torpedo 605 can also have a larger vented tube 620 connected to the back end 640 of the main body 615 to vent the air received from the tubular channels 645. The torpedo 605 can also have wings 625 connected to the back end 640 of the main body 615. And the deflation tubes 610 can be connected to (or forming part of) the wings 625 (and/or the larger vented tube 620). The deflation tubes 610 can have holes (or inlets) 630 located on a side of the tubes 610 closer to the wings 625 and/or the main body 615 (and/or the larger vented tube 620). The holes 630 and tubular channel 645 can be used independently of another (i.e. only one or the other) or together (i.e. as illustrated).

Figure 7:
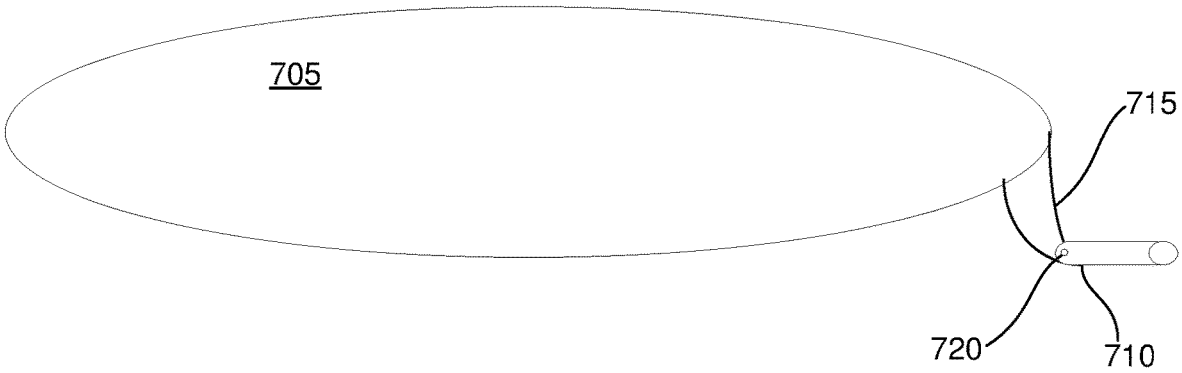
FIG. 7 shows another exemplary use with a buoyant body such as a surf board.

FIG. 7 shows another exemplary use of a deflation tube 710, with a buoyant body such as a surf board 705. Specifically, in the example shown, the buoyant body such as a surf board can have one or more hydrofoils such as a fin or a skeg 715. The deflation tube 710 may be attached to the fin or skeg 715, so that the deflation tube 710 and the inlet 720 thereof can perform functions similar to those described above.

Observations

These experiments, along with accompanying analysis, revealed a few insights. In general, tube lengths less than a critical length provide no deflation. The critical vented tube length required for deflation to occur is a function of sphere radius, impact velocity, and vented tube diameter. However, if the vented tube is longer than the lower cavity at deep seal pinch-off, the cavity will deflate. Larger tube lengths provide a consistent deflation rate; and as vented tube length and vented tube diameter increase, the amount of cavity deflation increases. Similarly, as vent hole area increases, the amount of cavity deflation increases up to a limit and then the vented tube fills with water before the cavity can fully deflate. The effect of impact velocity on the amount of cavity deflation varies depending on the vented tube length.

Accordingly, in one aspect, a tube can be designed by estimating the size of the trailing cavity of a projectile and configuring a deflating device (tube) to be at least longer than the expected trailing cavity when attached on the rear end of the projectile. That is because, if the straw is fully inside the cavity no deflation will occur. On the other hand, a longer straw or tube may generally be desirable because it is open to the air longer.

Relatedly, if the straw is longer than the cavity but below the surface at deep seal, only a small amount of deflation will occur. On the other hand, if the straw is above the surface at deep seal, then significantly more deflation may occur. For example, in one study, for a 2.54 cm diameter sphere, the straw lengths that were above the surface were 4.5 and 6 times the diameter of the sphere. Thus, if the length of the cavity for an object is known, the straw can be long enough that it will be above the surface (or inside the upper cavity as long as it is not closed, but rather open to the atmosphere) at deep seal. The longer the straw is above the surface, the more deflation will occur.

Thus, the tube or straw length can be dependent on the cavity length formed by the projectile in order for meaningful deflation of a cavity to occur. While there may not necessarily be a theoretical maximum length of the tube or straw, due to practical considerations the tube length in some applications can be limited to 10-12 times the tube diameter. The minimum effective length of the tube or straw may be referred to as the critical tube length, $L_{critical}$, which can be approximated by $$\frac{L_{critical}}{R} = 0.946\sqrt{Fr} - 1 - \frac{0.946d\sqrt{Fr}}{2RFr^{\frac{1}{5}}},$$

where $$Fr = U_0^2 / gR,$$

$U_o$ is the impact velocity, R is the radius of the sphere, and d is the diameter of the tube.

In addition, a larger straw diameter will allow for more air to leave the cavity and enter the straw. Thus, for a 1.27 cm diameter straw and 0.635 cm diameter straw with the same length and area ratio, the 1.27 cm diameter straw experienced greater deflation. In terms of deflation, a straw closer to the diameter of an object would be better than a straw much smaller than the diameter (e.g., 0.5 times the object diameter would be the minimum). As a general guideline, the tube cross-section area can be within about 50%, and often within about 10%, of the object diameter.

Any suitable cross-section may be utilized for the straw. In some aspects, the cross-section may be based at least partially on the shape or geometry of the projectile (e.g., for ease of coupling or integrating with the projectile). Relatedly, a straw or tube may be manufactured as part of the object or as a separate add-on piece. The manufacturing decision may depend on the object, and how the object is manufactured, and on developer/customer preference.

In another aspect, holes may be located as close to the object or projectile as possible to allow for as much of the cavity to deflate as possible. That is because once the cavity is below the holes, the cavity can no longer deflate. Accordingly, the higher the holes are (and the farther they are from the object or projectile), the larger the un-deflated cavity.

Relatedly, the larger the hole area, the quicker the air will be able to leave the cavity. With holes greater than or equal to a certain size, however, once the cavity reaches the holes the cavity will start to fill with water before the cavity can be completely deflated. In one example, the amount of deflation increased as the hole size increased for an area ratio of 0.1 to 1, but the difference in deflation between an area ratio of 1 and 2 was small. For a straw diameter of 1.27 cm, the critical area ratio is around 1. For an area ratio of 2, water began to fill the straw before the cavity was fully deflated. For a 0.635 cm straw, however, an area ratio of 2 did have more deflation than an area ratio of 1. The size of the hole for the 0.635 cm diameter, area ratio 2 straw is the same size as the hole of the 1.27 cm diameter, area ratio 0.5 straw. Thus, the amount of deflation may depend more on the hole size than the area ratio (at least in terms of when it will start filling with water and stop deflation). There may be a trade-off, as larger holes are desirable for faster, and therefore greater, deflation; but too large of holes may prevent the cavity from completely deflating. However, if the remaining cavity is small enough, it should shed easily and therefore most of the cavity would be removed, but not fully through deflation. For a similar reason, multiple rows of holes may be less desirable because once the cavity is below the first row of holes the tube may tend to fill with water and the air remaining below becomes trapped.

Additional experiments coupled with analysis revealed that as impact velocity increases, the cavity depth at deep seal increases. Further, as the depth increases, more air is entrained in the cavity at deep seal. Both the cavity depth and the cavity size at deep seal affect cavity deflation. The size of the cavity at deep seal impacts the size of the initial lower cavity and as the size of the initial lower cavity increases, the amount of air that needs to be deflated increases. The cavity depth at deep seal impacts the location of vented tube deep seal which, as previously discussed, impacts how much air can escape to the free surface. As the cavity depth increases, vented tube deep seal occurs higher on the vented tube and the amount of time the vented tube is in the upper cavity decreases. Thus, generally, when comparing the ratio of the remaining cavity after deflation to the initial lower cavity after deep seal, the higher the impact velocity, the less amount of deflation relative to initial lower cavity, while the lower the impact velocity, the greater the amount deflation relative to the initial lower cavity.

Deflation occurs if the vented tube is outside of the lower cavity at deep seal, which allows the air to escape from the cavity to the free surface through the vented tube. The vented tube is outside of the cavity if deep seal occurs on the vented tube. Deep seal depth may generally be considered half the cavity depth, and the cavity depth at deep seal may be a function of the Froude number. If the deep seal depth is half the cavity depth at deep seal then the lower cavity length at deep seal is equal to the seal depth. Vented tube deep seal occurs a few milliseconds before natural deep seal but the difference in depth is small and pinch-off still occurs at roughly half the cavity depth. For the vented tube to be outside of the cavity, the vented tube length plus the radius of the vented tube must be greater than the seal depth. Accordingly, an equation has been developed and derived for the minimum vented tube length required for deflation to occur. The equation is a function of sphere radius R, impact velocity $U_0$, and vented tube diameter d, and is $$\frac{L_{critical}}{R} = 0.946\sqrt{Fr} - 1 - \frac{0.946d\sqrt{Fr}}{2RFr^{\frac{1}{5}}}$$

where the Froude number $$Fr = U_0^2 / gR,$$

with g being the gravitational acceleration.

Acoustic and acceleration data was also collected and analyzed. Based on such analysis, it was observed that as the amount of deflation increases, the acoustic signature after deep seal, particularly at low frequencies, and acceleration after deep seal, decreases. Thus, when comparing acoustic signals and acceleration profiles for deflating cavities and non-deflating cavities, cavity deflation reduces both noise and acceleration after deep seal. Thus, the vented tube deflation technologies described herein have acoustic and acceleration reduction applications.

For example, a connected cavity can be passively removed with the cavity deflation systems described, and a violent collapse of the cavity may be avoided. Further, a projectile can enter and travel through water with reduced disturbance, decreasing the time taken for trailing cavities to deflate, ensure that fluid-activated compartments are activated in a timely manner, and decrease noise of collapse, as compared to the same objects without these systems.

In some of its applications, the deflation tube may function as an attachment to a projectile entering the water from above, such as air-launched torpedoes, and allow such weapons to more quickly activate. As a result, the technology described herein can reduce the effectiveness of an adversary's countermeasures, which may be depend on detectability and classification of incoming weapons. Nevertheless, a variety of applications can benefit from this technology, with non-limiting examples including not only torpedoes, but boat hulls, floating structures (i.e. support frames of ocean oil-platforms), and the like. Additionally, these devices can help reduce the chance of malfunction of vehicles due to cavities trailing propellers. Moreover, these devices can allow AUVs to enter the water from the air with less disturbance to, or without disturbing, marine environments.

While the foregoing exemplary embodiments are described in sufficient detail to enable those skilled in the art to practice the invention, it should be understood that other embodiments may be realized, and that various changes and modifications may be made without departing from the spirit and scope of the present invention. Thus, the aforementioned more detailed description of the embodiments and accompanying figures are not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

What is claimed is:

1. A device for deflating a gas cavity about a projectile formed upon entry of the projectile into a liquid, comprising:

an enclosure wall configured to couple with a body operable as a projectile, the wall defining an exterior and an interior space, and the wall being oriented toward a trailing end of the body relative to a leading end defined by the body;

at least one inlet to facilitate gas flow from the exterior to the interior space, the at least one inlet being oriented adjacent a leading end of the enclosure wall; and an outlet to facilitate gas flow from the interior space to the exterior, the outlet being oriented toward the trailing end relative to the at least one inlet, wherein, upon entry of the body and the wall into a liquid and formation of a gas cavity about a portion of the body and the wall, the at least one inlet is located within the gas cavity and the outlet is located outside the gas cavity, such that gas flows from the exterior through the at least one inlet to the interior space, and from the interior space through the outlet to the exterior to deflate the gas cavity.

2. The device of claim 1, wherein the wall is configured as a hollow tube and the at least one inlet comprises at least three openings in the wall evenly spaced around a circumference of the wall.

3. The device of claim 1, wherein the at least one inlet comprises at least one opening through the wall.

4. The device of claim 1, wherein the at least one inlet comprises a plurality of inlets all located at a same longitudinal position on a longitudinal axis extending between the leading and trailing ends.

5. The device of claim 1, wherein an axis of the at least one inlet is oriented perpendicular relative to a longitudinal axis extending between the leading and trailing ends.

6. The device of claim 1, wherein an axis of the outlet is parallel to a longitudinal axis extending between the leading and trailing ends.

7. The device of claim 1, wherein a ratio of inlet area to outlet area is from about 0.1 to about 2.

8. The device of claim 1, wherein a diameter of the wall is greater than or equal to 0.5 times a diameter of the body.

9. The device of claim 1, wherein the at least one inlets are oriented from the leading end within 2 times a diameter of the wall.

10. The device of claim 1, further comprising:

a second wall configured to couple with the body, the second wall defining a second interior space separated from the exterior, and the second wall being oriented toward the trailing end relative to the leading end;

at least one second inlet to facilitate gas flow from the exterior to the second interior space; and a second outlet to facilitate gas flow from the second interior space to the exterior, the second outlet being oriented toward the trailing end relative to the at least one second inlet, wherein, upon entry of the body and the second wall into the liquid and formation of the gas cavity, the at least one second inlet is located within the gas cavity and the second outlet is located outside the gas cavity, such that gas flows from the exterior through the at least one second inlet to the second interior space, and from the second interior space through the second outlet to the exterior to deflate the gas cavity.

11. The device of claim 1, further comprising a hydrophobic coating on at least a portion of the body, the wall, or both.

12. The device of claim 1, wherein the body forms at least a portion of a torpedo.

13. A system for deflating a gas cavity about a projectile formed upon entry of the projectile into a liquid, comprising:

a body operable as a projectile, the body having a leading portion defining a leading end;

a wall associated with the body, the wall defining an exterior and an interior space, and the wall being oriented toward a trailing end relative to the leading end;

at least one inlet to facilitate gas flow from the exterior to the interior space; and an outlet to facilitate gas flow from the interior space to the exterior, the outlet being oriented toward the trailing end relative to the at least one inlet, wherein, upon entry of the body and the wall into a liquid and formation of a gas cavity about a portion of the body and the wall, the at least one inlet is located within the gas cavity and the outlet is located outside the gas cavity, such that gas flows from the exterior through the at least one inlet to the interior space, and from the interior space through the outlet to the exterior to deflate the gas cavity.

14. The system of claim 13, wherein the wall is a separate and distinct structure from the body.

15. The system of claim 13, wherein the wall is integrated into the body structure.

16. The system of claim 13, wherein the wall is configured as a hollow tube and the at least one inlet comprises at least three openings in the wall evenly spaced around a circumference of the wall.

17. The system of claim 13, wherein the at least one inlet comprises a plurality of inlets all located at a same longitudinal position on a longitudinal axis extending between the leading and trailing ends.

18. The system of claim 13, wherein an axis of the at least one inlet is oriented perpendicular relative to a longitudinal axis extending between the leading and trailing ends.

19. The system of claim 13, wherein an axis of the outlet is parallel to a longitudinal axis extending between the leading and trailing ends.

20. The system of claim 13, wherein a ratio of inlet area to outlet area is from about 0.1 to about 2 and a diameter of the wall is greater than or equal to 0.5 times a diameter of the body.

21. The system of claim 13, further comprising:

a second wall configured to couple with the body, the second wall defining a second interior space separated from the exterior, and the second wall being oriented toward the trailing end relative to the leading end;

at least one second inlet to facilitate gas flow from the exterior to the second interior space; and a second outlet to facilitate gas flow from the second interior space to the exterior, the second outlet being oriented toward the trailing end relative to the at least one second inlet, wherein, upon entry of the body and the second wall into the liquid and formation of the gas cavity, the at least one second inlet is located within the gas cavity and the second outlet is located outside the gas cavity, such that gas flows from the exterior through the at least one second inlet to the second interior space, and from the second interior space through the second outlet to the exterior to deflate the gas cavity.

22. The system of claim 13, further comprising a hydrophobic coating on at least a portion of the body, the wall, or both.

23. The system of claim 13, wherein the body forms at least a portion of a torpedo.

* * * * *